US006120134A

United States Patent [19]

Lee

[11] Patent Number: 6,120,134

[45] Date of Patent: Sep. 19, 2000

[54] INK JET PRINT HEAD INCLUDING THIN FILM LAYERS HAVING DIFFERENT RESIDUAL STRESSES

[75] Inventor: Byung-chan Lee, Kyonggi-do, Rep. of Korea

[73] Assignee: Samsung Electronics Co., Ltd., Suwon, Rep. of Korea

[21] Appl. No.: 09/076,886

[22] Filed: May 13, 1998

[30] Foreign Application Priority Data

May 15, 1997 [KR] Rep. of Korea ..... 97/18789

[51] Int. Cl.[7] ..... B41J 2/04

[52] U.S. Cl. ..... 347/54

[58] Field of Search ..... 347/54, 74, 75

[56] References Cited

U.S. PATENT DOCUMENTS

| | | | |
|---|---|---|---|
| 5,666,141 | 9/1997 | Matoba et al. | 347/54 |
| 5,684,519 | 11/1997 | Matoba et al. | 347/54 |
| 5,757,401 | 5/1998 | Abe et al. | 347/54 X |
| 5,825,383 | 10/1998 | Abe et al. | 347/54 |

*Primary Examiner*—William J. Royer
*Attorney, Agent, or Firm*—Staas & Halsey LLP

[57] ABSTRACT

An ink jet print head, which sprays ink continuously by fixing an ink spray unit on which thin film layers each having a different residual stress are deposited so that both ends thereof are fixed on an ink chamber barrier layer located at the lower part of a nozzle plate, applying an electrostatic force to the thin film layers and then applying an impact force generated by the extension of the absolute lengths of the thin film layers caused by the difference of the residual stresses of the thin film layers.

22 Claims, 4 Drawing Sheets

INK JET PRINT HEAD INCLUDING THIN FILM LAYERS HAVING DIFFERENT RESIDUAL STRESSES

BACKGROUND OF THE INVENTION

1. Field of the Invention

The present invention relates to an ink jet print head, and more particularly, to an ink jet print head and its manufacturing method. The ink jet print head is capable of spraying ink continuously by fixing an ink spray unit on which thin film layers each having a different residual stress are deposited so that both ends of a lowest one of the thin film layers are fixed on an ink chamber barrier layer located at the lower part of a nozzle plate, applying an electrostatic force to the thin film layers and then applying an impact force generated by the variation of lengths of the thin film layers which are deposited.

2. Description of the Related Art

Technologies used in a cartridge of an ink-jet printer of a conventional drop on demand type are divided into a piezo-type of an Epson which uses a piezoelectric material; and a thermal type of a Hewlett Packard, a Canon and a Xerox which sprays ink using heat generated from an exothermic body. In addition, a cartridge of a continuous spray type using a magnetic force and an electrostatic force has been supplied.

In the case of spraying ink by the piezo-type, a displacement is generated by applying a driving signal to the piezoelectric material and then the displacement is transmitted to the ink, thereby allowing the ink to be sprayed. In the case of the thermal type, when the driving signal applied to an electrode passes an exothermic body having a large resistance, the ink is boiled by heat which is generated from the exothermic body.

In addition, in the continuous spray type using the magnetic force and electrostatic force, printing is performed by continuously spraying a conductive ink and changing paths of the ink bubbles by generating the magnetic force and electrostatic force according to the driving signal. This type has a benefit in that the printing speed is very fast. However, a lot of ink is expended in this continuous spray type, and therefore it is not really economical.

SUMMARY OF THE INVENTION

Therefore, it is an object of the present invention to provide an ink jet print head of a continuous spray type which has a simple principle and structure and enhances the operation cycle.

It is another object of the present invention to provide an ink jet print head of a continuous spray type having enhanced functions and a lengthened life.

It is still another object of the present invention to provide an ink jet print head of a continuous spray type which reduces the cost of manufacturing by simplifying the structure.

Additional objects and advantages of the invention will be set forth in part in the description which follows and, in part, will be obvious from the description, or may be learned by practice of the invention.

To achieve the above and other objects and advantages, the ink jet print head of the present invention includes a nozzle plate having a plurality of nozzle orifices; an ink chamber barrier layer which is located at a lower part of the nozzle plate and has an ink chamber at an inside thereof; and an ink spray unit having a plurality of thin film layers each having a different residual stress from each other, wherein one of the plurality of thin film layers (a lowest one) has both ends thereof fixed on the upper surface of the ink chamber barrier layer.

Preferably, the ink spray unit includes upper and lower thin film layers each having a different residual stress. Preferably, the upper thin film layer has a tensile residual stress and the lower thin film layer has a compressed residual stress. Preferably, the upper thin film layer is made of nickel (Ni) or titanium (Ti). Preferably, the lower thin film layer is made of aluminum and is an electrode layer to which power is applied.

Moreover, the ink spray unit may include a supporting layer and the upper and lower thin film layers each having a different residual stress. Preferably, the supporting layer is a silicon oxide film. Preferably, the ink chamber barrier layer is made of a silicon wafer.

According to the first embodiment of the present invention, a method of manufacturing the ink jet print head to achieve the above and other objects includes the steps of forming an etching prevention layer at a lower surface of an ink chamber barrier layer made of a silicon wafer; forming an ink chamber inside of the ink chamber barrier through isotropic wet etching; forming a thin film layer having a compressed residual stress to traverse the ink chamber and to fix both of its ends on the surface of the ink chamber barrier layer; and forming a thin film layer having a tensile residual stress at the upper surface of the thin film layer having the compressed residual stress.

Preferably, in the first embodiment of the present invention, the etching prevention layer is formed by one of a sputtering method, a lift-off method and a process for forming a thermal oxide film. Preferably, the thin film layer having the compressed residual stress is made of aluminum (Al). Preferably, the thin film layer having the tensile residual stress is made of nickel (Ni) or titanium (Ti).

According to a second embodiment of the present invention, a method of manufacturing the ink jet print head to achieve the above and other objects includes the steps of forming an etching prevention layer at a lower surface of an ink chamber barrier layer; forming a silicon oxide film at the surface of the ink chamber barrier layer; forming an ink chamber in the ink chamber barrier layer through an isotropic wet etching of the ink chamber barrier layer and the silicon oxide film and forming a silicon oxide film supporting layer to traverse a center of the ink chamber; sputtering a thin film layer having a compressed residual stress on an upper surface of the silicon oxide film supporting layer; and sputtering a thin film layer having a tensile residual stress on the upper surface of the thin film layer having the compressed residual stress.

Preferably, in the second embodiment of the present invention, the etching prevention layer is formed by one of a sputtering method, a lift-off method and a process for forming a thermal oxide film. Preferably, the silicon oxide film is formed by one of a sputtering method, a lift-off method and a process for forming a thermal oxide film. Preferably, the thin film layer having the compressed residual stress is made of aluminum (Al). Preferably, the thin film layer having the tensile residual stress is made of nickel (Ni) or titanium Ti.

The ink jet print head and its manufacturing method according to the present invention are directed to generate a tensile force at the thin film layer by applying an electrostatic force to the upper and lower thin film layers each having a different residual stress, and to generate a displacement between the two different thin film layers by combination of the tensile force caused by the electrostatic force and the different residual stress, thereby transmitting the impact force. Using the displacement and impact force, the ink is sprayed through nozzles.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

The objects, characteristics and advantages of the above-described invention will be more clearly understood through the preferable embodiments referring to the attached drawings.

Figure 1:
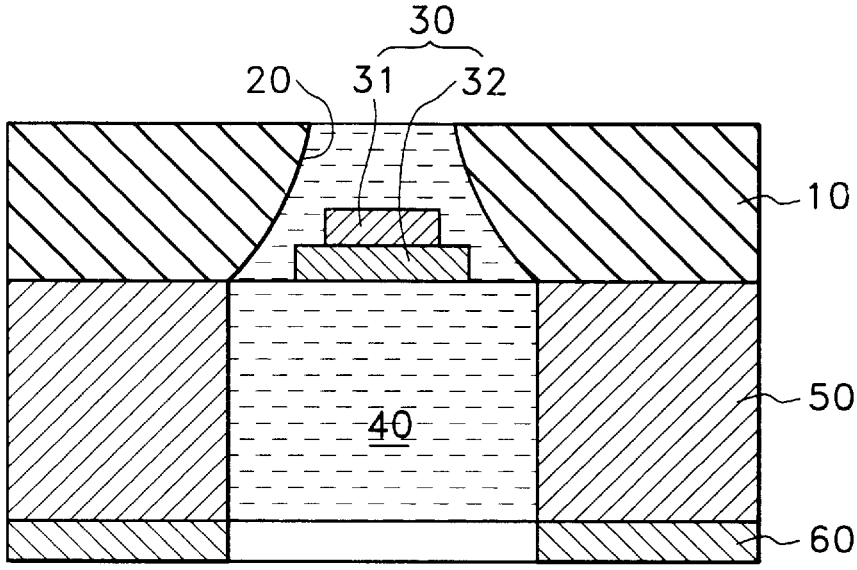
FIG. 1 is a sectional view of an ink jet print head according to a first embodiment of the present invention.
Figure 2:
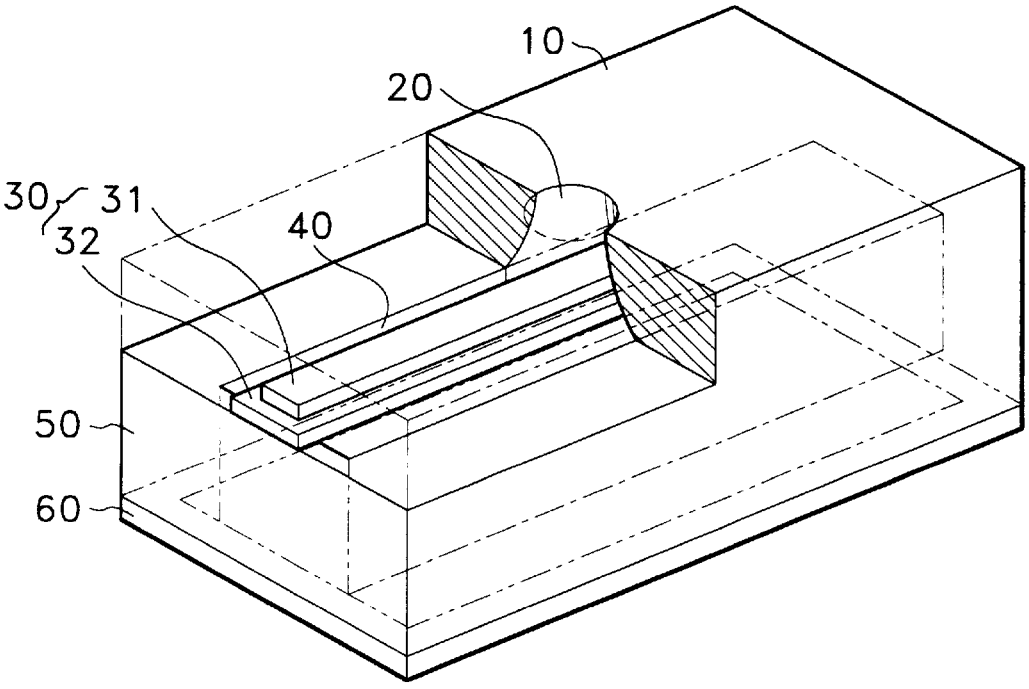
FIG. 2 is a perspective view which is partly cut illustrating the ink jet print head shown in FIG. 1 according to the first embodiment of the present invention.
Figure 3:
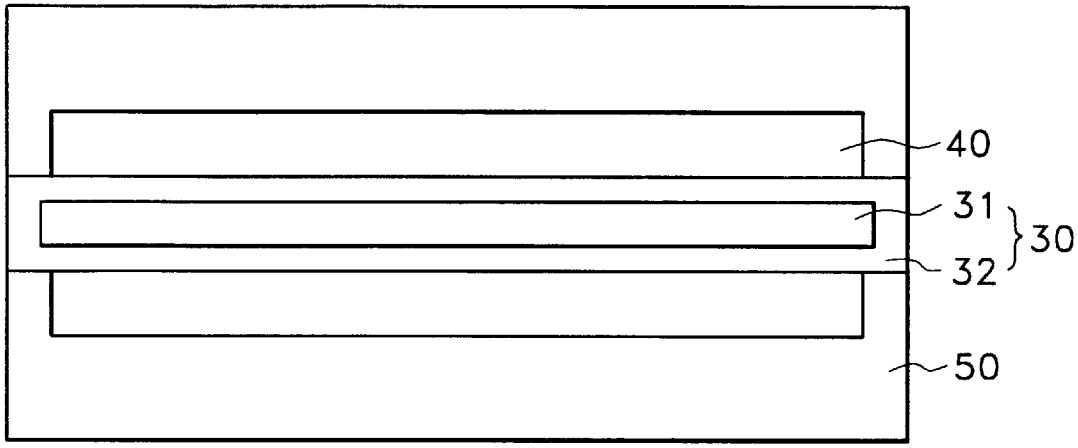
FIG. 3 is a plan view illustrating the ink jet print head shown in FIG. 1 with the exception of a nozzle plate shown in FIGS. 1 and 2.

FIG. 1 is a sectional view of an ink jet print head according to a first embodiment of the present invention; FIG. 2 is a perspective view which is partly cut illustrating the ink jet print head shown in FIG. 1; and FIG. 3 is a plan view illustrating the ink jet print head shown in FIG. 1, excluding a nozzle plate.

As illustrated in the drawings, an ink jet print head according to the first embodiment of the present invention includes a nozzle plate 10 having a plurality of nozzle orifices 20; an ink spray unit 30 which is located at a lower part of each of the nozzle orifices 20; an ink chamber 40 for storing ink; and an ink chamber barrier layer 50 on which both ends of the ink spray unit 30 are supported.

The ink spray unit 30 includes upper and lower thin film layers which are deposited each having a different residual stress. The upper thin film layer is a thin film layer 31 having a tensile residual stress when an electrostatic force is applied; and the lower thin film layer is a thin film layer 32 having a compressed residual stress and acts as an electrode layer to which power is applied.

In the ink spray unit 30 including the upper and lower thin film layers 31 and 32 which are deposited, in order for the upper and lower thin film layers 31 and 32 to be bent for spraying ink by the electrostatic force applied to the lower thin film layer 32, i.e., electrode layer, the absolute value of the compressed residual stress of the lower thin film layer 32 should be larger than that of the tensile residual stress of the upper thin film layer 31.

The upper thin film layer 31 is deposited by a metal such as nickel Ni, titanium Ti, etc., and the lower thin film layer 32 is deposited by aluminum (Al).

The ink chamber barrier layer 50 is made of a silicon wafer. At the inside of the ink chamber barrier layer 50, the ink chamber 40 is formed. At the lower surface, an etching prevention layer 60 is deposited.

Figure 4:
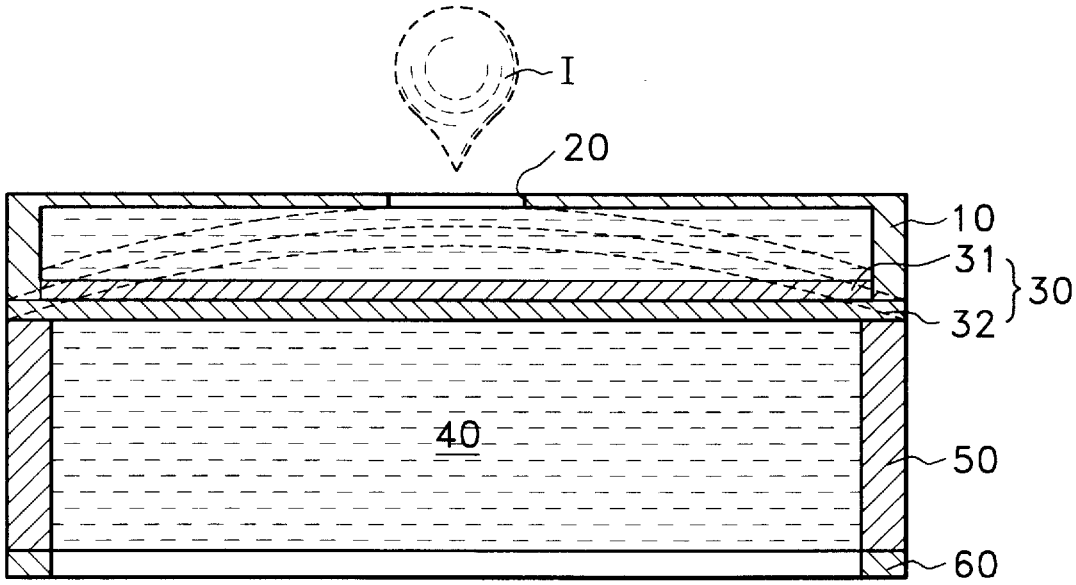
FIG. 4 is a sectional view illustrating the operation of the ink jet print head according to the first embodiment of the present invention.

The operation of the present invention is explained with reference to the sectional view shown in FIG. 4, in which the ink jet print head is cut in the longitudinal direction. As shown in FIG. 4, before starting operation of the ink jet print head, each of the upper and lower thin film layers 31 and 32 maintains a neutral state as indicated by solid lines.

Here, when the power is applied to the electrode layer, i.e., the lower thin film layer 32, an electrostatic force is generated at the upper thin film layer 31 through the lower thin film layer 32. Accordingly, the length of the lower thin film layer 32 having the compressed residual stress is enlarged, and the length of the upper thin film layer 31 having the tensile residual stress is also enlarged. As a result, the absolute lengths of the upper and lower thin film layers are enlarged. Because the absolute value of the compressed residual stress of the lower thin film layer 32 is larger than that of the tensile residual stress of the upper thin film layer 31, central parts of the upper and lower thin film layers are bent toward the nozzle plate 10, as indicated by the curved dotted lines in FIG. 4.

Accordingly, since a strong impact is applied to the ink stored between the upper and lower thin film layers 31 and 32 and the nozzle plate 10, the ink (I) is sprayed through the nozzle orifice 20.

A method of manufacturing the ink jet print head according to the first embodiment of the present invention will be explained, with reference to FIGs. 5A to 5D.

Figure 5A:
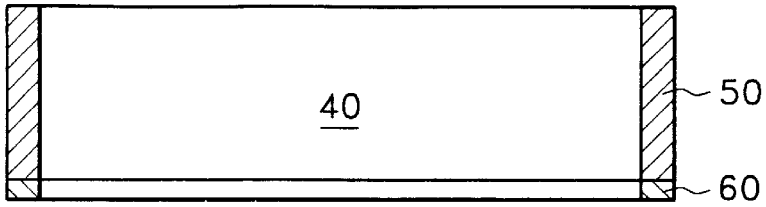
FIGS. 5A to 5D are sectional views successively illustrating a method of manufacturing the ink jet print head according to the first embodiment of the present invention.

First, as shown in FIG. 5A, the etching prevention layer 60 is formed at a lower surface of the ink chamber barrier layer 50 by a sputtering method, a lift-off method or a process of forming a thermal oxide film. At the inside of the ink chamber barrier layer 50, the ink chamber 40 is formed through an isotropic wet etching.

Figure 5B:
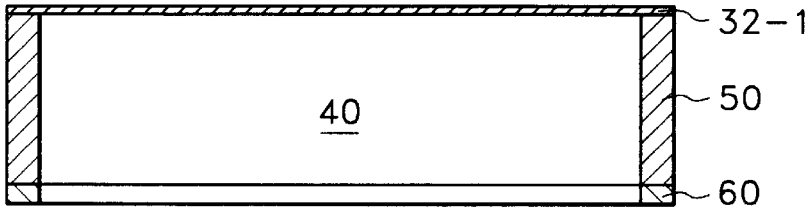

As shown in FIG. 5B, both ends of a support 32-1 made of aluminum and having a thin thickness is fixed at an upper surface of the ink chamber barrier layer 50 opposite to the lower surface on which the etching prevention layer 60 is formed.

Figure 5C:
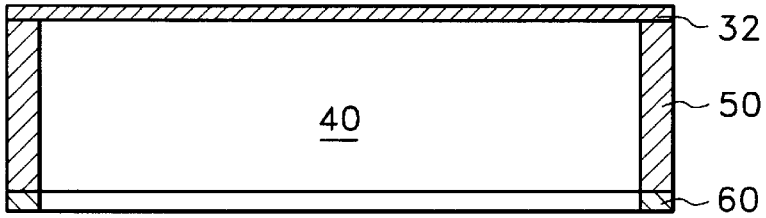
Figure 5D:
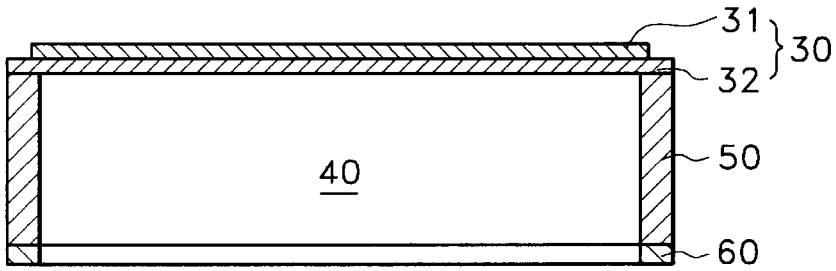

After that, as shown in FIG. 5C, the lower thin film layer 32 having the compressed residual stress is formed by sputtering aluminum (Al) on the upper surface of the support 32-1. And then, as shown in FIG. 5D, the upper thin film layer 31 having the tensile residual stress by sputtering nickel (Ni) or titanium (Ti) on the upper surface of the lower thin film layer 32 having the compressed residual stress.

Here, the lower thin film layer 32 having the compressed residual stress acts in a role as the electrode layer. In addition, the upper and lower thin film layers 31 and 32 are supported by both side (left and right in the drawings) walls of the ink chamber barrier layer 50.

The method of manufacturing of the ink jet print head according to a second embodiment of the present is illustrated, with reference to FIGS. 6A to 6D.

Figure 6A:
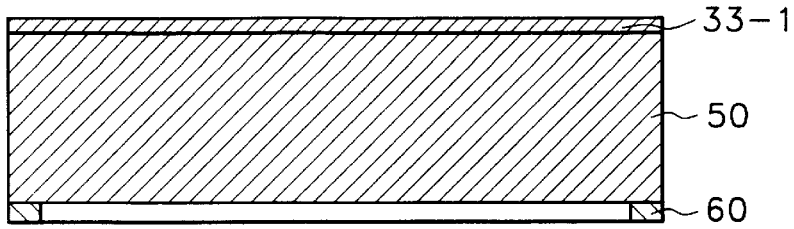
FIGS. 6A to 6D are sectional views successively illustrating a method of manufacturing an ink jet print head according to a second embodiment of the present invention.
Figure 6B:
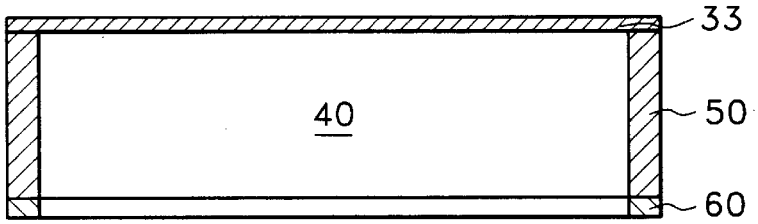

First, as shown in FIG. 6A, the etching prevention layer 60 is formed at the lower surface of the ink chamber barrier layer 50, and a silicon oxide film 33-1 having a rectangular shape is formed at the center of the upper surface of the ink chamber barrier layer 50 in the longitudinal direction. After that, the isotropic wet etching is performed at the lower surface of the ink chamber barrier layer 50, leaving the parts where the etching prevention layer 60 and the silicon oxide film 33-1 are present. As a result, the ink chamber 40 is formed in the inside region of the ink chamber barrier layer 50, and a supporting layer 33 (from the silicon oxide film 33-1) is formed at an upper surface of the ink chamber barrier layer 50 opposite to the lower surface on which the etching prevention layer 60 is formed, as shown in FIG. 6B.

Figure 6C:
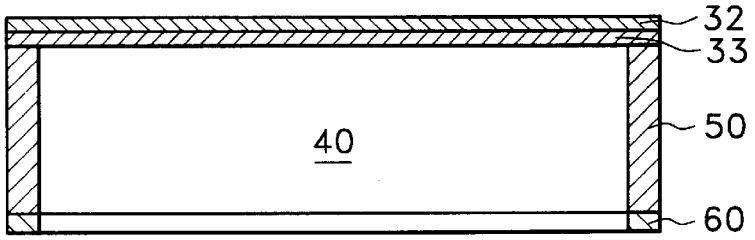

As described above, by sputtering aluminum on the upper surface of the supporting layer 33 formed on the upper surface of the ink chamber barrier layer 50, the thin film layer 32 having the compressed residual stress is formed, as shown in FIG. 6C.

Figure 6D:
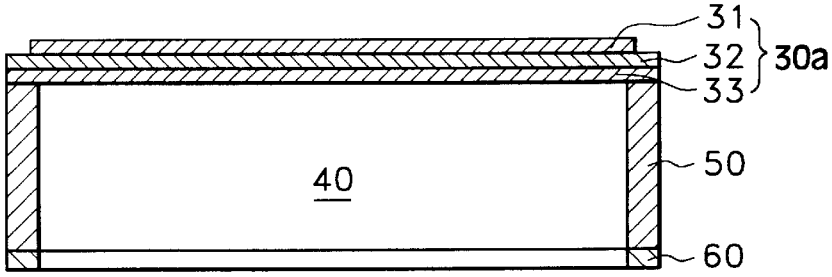

After that, by sputtering nickel (Ni) or titanium (Ti) on the surface of the thin film layer 32 having the compressed residual stress, the thin film layer 31 having the tensile residual stress is formed, as shown in FIG. 6D, thereby producing an ink spray unit 30*a*.

Accordingly, the two thin film layers 31 and 32 deposited on the upper surface of the supporting layer 33 are supported/fixed at both side (left and right in the drawings) walls of the ink chamber barrier layer 50 by traversing the central part of the ink chamber 40 at the upper surface of the ink chamber barrier layer 50. Here, the lower thin film layer 32 acts in a role as the electrode layer.

As described above, in manufacturing the ink jet print head, the present invention reduces the manufacturing process in comparison to the conventional continuous spray type, thereby enhancing the productivity by more than 30 percent.

According to the ink jet print head of the present invention, the droplet frequency of the ink is enhanced by the ink spray operation performed by the bent upper and lower thin film layers, and printing having a high resolution can be realized.

Moreover, since the structure of the ink jet print head is simplified and the operation facilities for manufacturing the same is decreased, the manufacturing cost is reduced. In addition, the life of the ink jet print head is lengthened, and as a result, the capacity of the ink cartridge is increased.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. An ink jet print head, comprising:

a nozzle plate having a plurality of nozzle orifices and a lower part;

an ink chamber barrier layer formed at the lower part of said nozzle plate, said ink chamber barrier layer having an opening which forms an ink chamber and an upper surface; and an ink spray unit having a plurality of thin film layers, each layer having a different residual stress from each other, wherein both ends of one of the plurality of thin film layers are fixed on the upper surface of said ink chamber barrier layer.

2. The ink jet print head of claim 1, wherein said plurality of thin film layers comprises upper and lower thin film layers each having a different residual stress from each other.

3. The ink jet print head of claim 2, wherein said upper thin film layer has a tensile residual stress and said lower thin film layer has a compressed residual stress.

4. The ink jet print head of claim 3, wherein said lower thin film layer is an electrode layer to which power is applied.

5. The ink jet print head of claim 3, wherein said lower thin film layer is made of aluminum (Al).

6. The ink jet print head of claim 3, wherein said upper thin film layer is made of nickel (Ni) or titanium (Ti).

7. The ink jet print head of claim 1, wherein said ink chamber barrier layer is made of a silicon wafer.

8. An ink jet print head, comprising:

a nozzle plate having a plurality of nozzle orifices and a lower part;

an ink chamber barrier layer formed at the lower part of said nozzle plate, said ink chamber barrier layer having an opening which forms an ink chamber and an upper surface; and an ink spray unit having a plurality of thin film layers each layer having a different residual stress from each other, wherein both ends of one of the plurality of thin film layers are fixed on the upper surface of said ink chamber barrier layer, wherein said ink spray unit further comprises a supporting layer having an upper surface and said plurality of thin film layers include lower and upper thin film layers, each having a different residual stress from each other and which are successively deposited on the upper surface of said supporting layer.

9. The ink jet print head of claim 8, wherein said upper thin film layer has a tensile residual stress and said lower thin film layer has a compressed residual stress.

10. The ink jet print head of claim 9, wherein said lower thin film layer is an electrode layer to which power is applied.

11. The ink jet print head of claim 9, wherein said lower thin film layer is made of aluminum (Al).

12. The ink jet print head of claim 9, wherein said upper thin film layer is made of nickel (Ni) or titanium (Ti).

13. The ink jet print head of claim 8, wherein said supporting layer is a silicon oxide film.

14. An ink jet print head to eject ink in response to power, comprising;

a nozzle plate having a nozzle orifice;

an ink chamber barrier layer attached to said nozzle plate, said ink chamber barrier layer having an ink chamber to store the ink and leading to the nozzle orifice; and an ink spray unit having first and second thin film layers formed adjacent to each other, each layer having a different residual stress, wherein said first and second thin film layers bend to eject ink from said ink chamber through said nozzle orifice in response to the power being applied to one of said first and second thin film layers.

15. The ink jet print head as claimed in claim 14, wherein:

said ink chamber barrier layer has a surface;

said nozzle plate is attached to a first portion of said surface;

said first thin film layer is formed over said ink chamber, has first and second ends attached to second and third portions of said surface different from said first portion, respectively, for support, and has a compressed residual stress; and said second thin film layer is formed on said first thin film layer and has a tensile residual stress.

16. The ink jet print head as claimed in claim 15, wherein an absolute value of the compressed residual stress of said first thin film layer is larger than that of the tensile residual stress of said second thin film layer.

17. The ink jet print head as claimed in claim 15, wherein said first and second thin film layers bend away from said ink chamber and into said nozzle orifice in response to the power being applied to one of said first and second thin film layers, to eject ink from said ink chamber and through said nozzle orifice.

18. The ink jet print head as claimed in claim 14, wherein:

said ink chamber barrier layer has a first surface, and said ink chamber extends to the surface;

said nozzle plate has a second surface attached to a first portion of said first: surface of said ink chamber barrier layer and a third surface opposite said second surface, and said nozzle orifice extends from said second surface to said third surface, said nozzle orifice and said ink chamber meeting at said first and second surfaces;

said first thin film layer is formed over said ink chamber, has first and second ends attached to second and third portions of said first surface different from said first portion, respectively, for support, and has a compressed residual stress; and said second thin film layer is formed on said first thin film layer and has a tensile residual stress.

19. The ink jet print head as claimed in claim 18, wherein:

said ink chamber forms a substantially rectangular shape at said first surface; and said nozzle orifice forms a substantially rectangular shape at said second surface which overlaps said substantially rectangular shape of said ink chamber, forms a substantially circular shape having a smaller area than said substantially rectangular shape thereof at said third surface, and has sloped surfaces extending from said substantially rectangular shape thereof to said substantially circular shape.

20. The ink jet print head as claimed in claim 19, wherein:

said first thin film layer has a substantially rectangular shape and extends over only a portion of said substantially rectangular shape of said ink chamber; and said second thin film layer has a substantially rectangular shape and an area less than that of said substantially rectangular shape of said first thin film layer.

21. An ink jet print head to eject ink in response to power, comprising;

a nozzle plate having a nozzle orifice;

an ink chamber barrier layer attached to said nozzle plate, said ink chamber barrier layer having an ink chamber to store the ink and leading to the nozzle orifice, wherein said ink chamber barrier layer has a surface, and said nozzle plate is attached to a first portion of said surface;

an ink spray unit having first and second thin film layers formed adjacent to each other, each layer having a different residual stress, wherein said first and second thin film layers bend to eject ink from said ink chamber through said nozzle orifice in response to the power being applied to one of said first and second thin film layers;

a supporting layer formed over said ink chamber, said supporting layer having first and second ends attached to second and third portions of said surface different from said first portion, respectively;

said first thin film layer is formed on said supporting layer, and has a compressed residual stress; and said second thin film layer is formed on said first thin film layer and has a tensile residual stress.

22. The ink jet print head as claimed in claim 21, wherein said supporting layer is a silicon oxide film.

* * * * *